US006896040B2

(12) United States Patent
Hul-Chun

(10) Patent No.: US 6,896,040 B2
(45) Date of Patent: May 24, 2005

(54) WICK STRUCTURE OF HEAT PIPES

(76) Inventor: Hsu Hul-Chun, 6F-3, No. 422, Sec. 2, Li-Ming Rd., Taichung (TW)

( * ) Notice: Subject to any disclaimer, the term of this patent is extended or adjusted under 35 U.S.C. 154(b) by 0 days.

(21) Appl. No.: 10/863,474

(22) Filed: Jun. 9, 2004

(65) Prior Publication Data

US 2005/0022980 A1 Feb. 3, 2005

(30) Foreign Application Priority Data

Jul. 18, 2003 (TW) ..... 92213135 U

(51) Int. Cl.[7] ..... F28D 15/00

(52) U.S. Cl. ..... 165/104.26; 165/104.21; 29/890.032

(58) Field of Search ..... 165/104.21, 104.26, 165/177; 361/699, 700; 257/714, 715; 174/15.2; 29/890.032

(56) References Cited

U.S. PATENT DOCUMENTS 3,680,189 A * 8/1972 Noren ..... 29/890.032
3,892,273 A * 7/1975 Nelson ..... 165/104.26
4,003,427 A * 1/1977 Leinoff et al. ..... 165/104.26
4,109,709 A * 8/1978 Honda et al. ..... 165/104.26
4,470,451 A * 9/1984 Alario et al. ..... 165/104.26
5,412,535 A * 5/1995 Chao et al. ..... 361/700

FOREIGN PATENT DOCUMENTS

JP 57010093 A * 1/1982
JP 58182085 A * 10/1983
JP 2000074580 A * 3/2000

* cited by examiner

*Primary Examiner*—Tho v Duong

(57) ABSTRACT

A configured structure of a heat pipe wick structure, having a hollow tube with two ends and a wick structure disposed in the hollow tube and lining on an interior wall of the hollow tube. The wick structure has an opening part and a folded part at two ends of the hollow tube. The folded part has a folded surface pressed inwardly against the hollow tube, and two counter-folded surfaces at two sides of the folded surface. The edges at two sides of the folded surface are overlapped with the counter-folded surfaces, such that the folded surface and the counter-folded surfaces are sandwiched between the hollow tube and the bulk of the wick structure.

4 Claims, 6 Drawing Sheets

WICK STRUCTURE OF HEAT PIPES

BACKGROUND OF THE INVENTION

The present invention relates generally to a configured structure of the wick structure lining along an interior surface of a heat pipe and, more particularly, to a configured structure of the wick structure that provides a reinforced connection between the wick structure and the heat pipe, and is advantageous for lining the wick structure into the heat pipe.

Heat pipes, by having the features of high thermal conductive, quick thermal response, no moving parts, simple structure and multi-functions, can transfer huge amount of heat without consuming significant amount of electricity. Therefore, heat pipes are suitable for heat dissipation of electronic products. In addition, the interior wall of the conventional heat pipe includes wick structure. The wick structure includes web for capillary effect, which is advantageous for transmission of working fluid in the heat pipe.

While installing the wick structure into the heat pipe, a wick structure configured with two openings at two ends thereof is winded about a core bar. The wick structure is gradually guided in the heat pipe by the core bar. As the fiction between the wick structure and the heat pipe is larger than that between the wick structure and the core bar, the core bar is easily withdrawn after the wick structure is disposed in the heat pipe. The wick structure is thus in contact with the heat pipe, and the installation of the configured wick structure is complete.

However, the above conventional installing method does not provide any fastening or fitting structure. Instead, the wick structure is attached to the core bar solely by friction. Therefore, duration installation, the wick structure is easily peeled off or wrinkled, such that the installation process can not be automated. As the installation of the wick structure has to be performed manually, the quality is difficult to control.

Therefore, there exist inconvenience and drawbacks for practically application of the above conventional wick structure of the heat pipes. There is thus a substantial need to provide a configured structure of the heat pipe wick structure that resolves the above drawbacks and can be used more conveniently and practically.

BRIEF SUMMARY OF THE INVENTION

The present invention provides a configured structure installed in a tube for forming a wick structure of a heat pipe. Before disposing the wick structure into the heat pipe, one end of the wick structure is folded to form a folded part. This folded part reinforces the connection between the wick structure and the heat pipe, and is advantageous for inserting the wick structure into the heat pipe. Thereby, automatic equipment can be utilized to obtain a heat pipe lined with enhanced wick structure.

The heat pipe provided by the present invention comprises a hollow tube and a wick structure inserted into the hollow tube and lining on an interior surface thereof. At two ends of the hollow tube, the wick structure includes an opening part and a folded part, respectively. The folded part includes a folded surface pressed inwardly with respect to the hollow tube and two counter folded surfaces at two side of the folded surface. The edges at two sides of the folded surface are overlapped with the counter folded surfaces, such that the folded and counter-folded surfaces can be sandwiched between the hollow tube and the bulk of the wick structure.

BRIEF DESCRIPTION OF THE DRAWINGS

These, as well as other features of the present invention, will become more apparent upon reference to the drawings wherein.

DETAILED DESCRIPTION OF THE INVENTION

Figure 1:
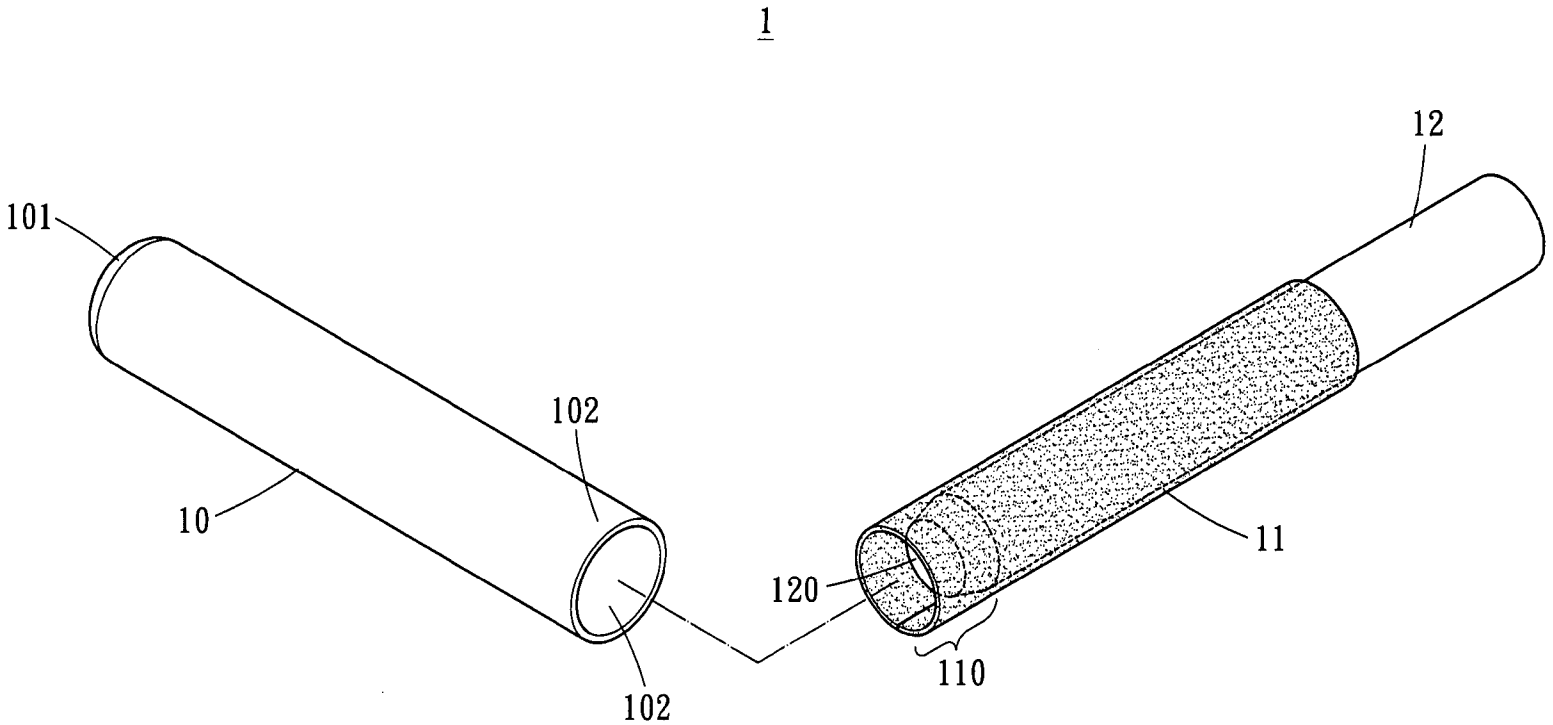
FIG. 1 shows a wick structure to be inserted into a hollow tube of a heat pipe according to the present invention.

The present invention provides a configured structure for heat pipe wick structure. A perspective view of a wick structure to be inserted in a heat pipe is shown in FIG. 1. The heat pipe 1 includes a hollow tube 10 and a wick structure 11 to be inserted into the tube 10.

The tube 10 includes two ends 100 and 101. Before installing the wick structure 11 into the tube 10, at least the end 100 is open to form the opening 102, through which the wick structure 10 is installed in the tube 10. The wick structure 11 includes metal web, fiber web or non-woven fabric mesh.

Before installing the wick structure 11 into the tube 10, the wick structure 11 is winding about a core bar 12. The wick structure 11 protrudes from one end surface 120 of the core bar 12 to form a hollow column 110. Distal to the column 111, as shown in FIG. 5, an open part 111 of the wick structure 11 is formed allowing the core bar 12 to pass through.

Figure 2:
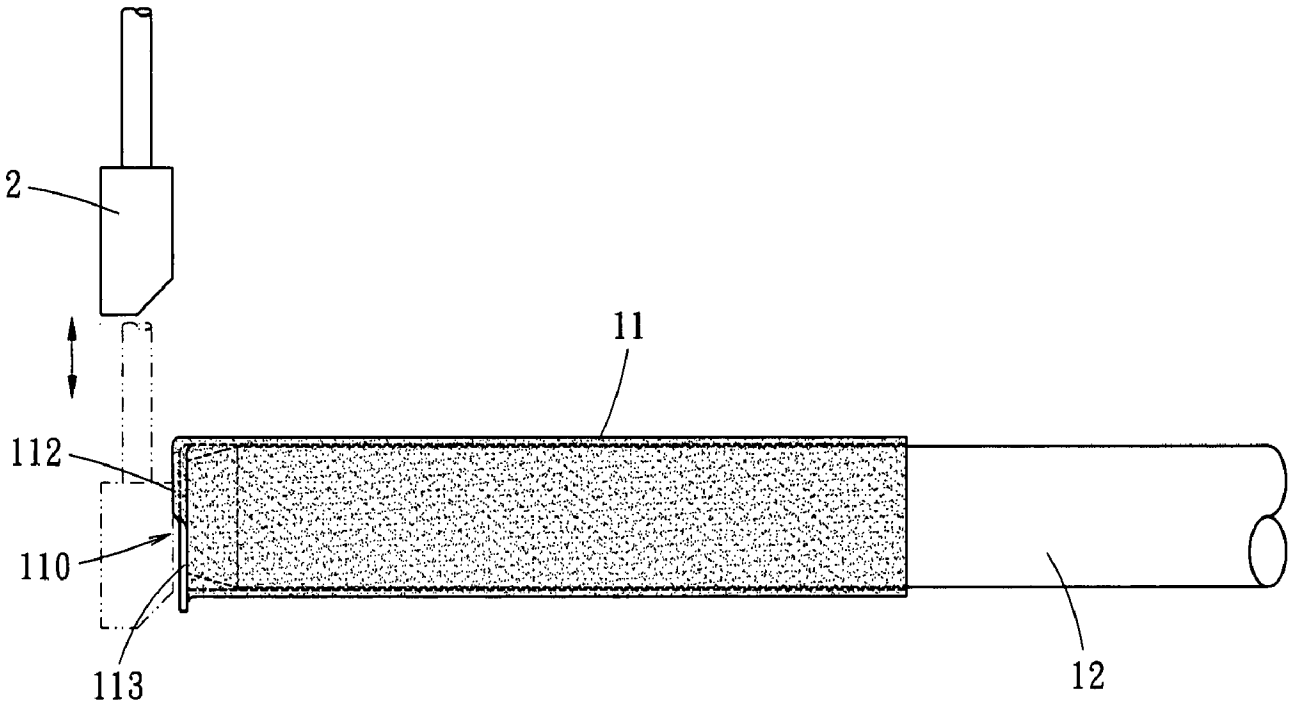
FIG. 2 shows the press operation of the wick structure.
Figure 3:
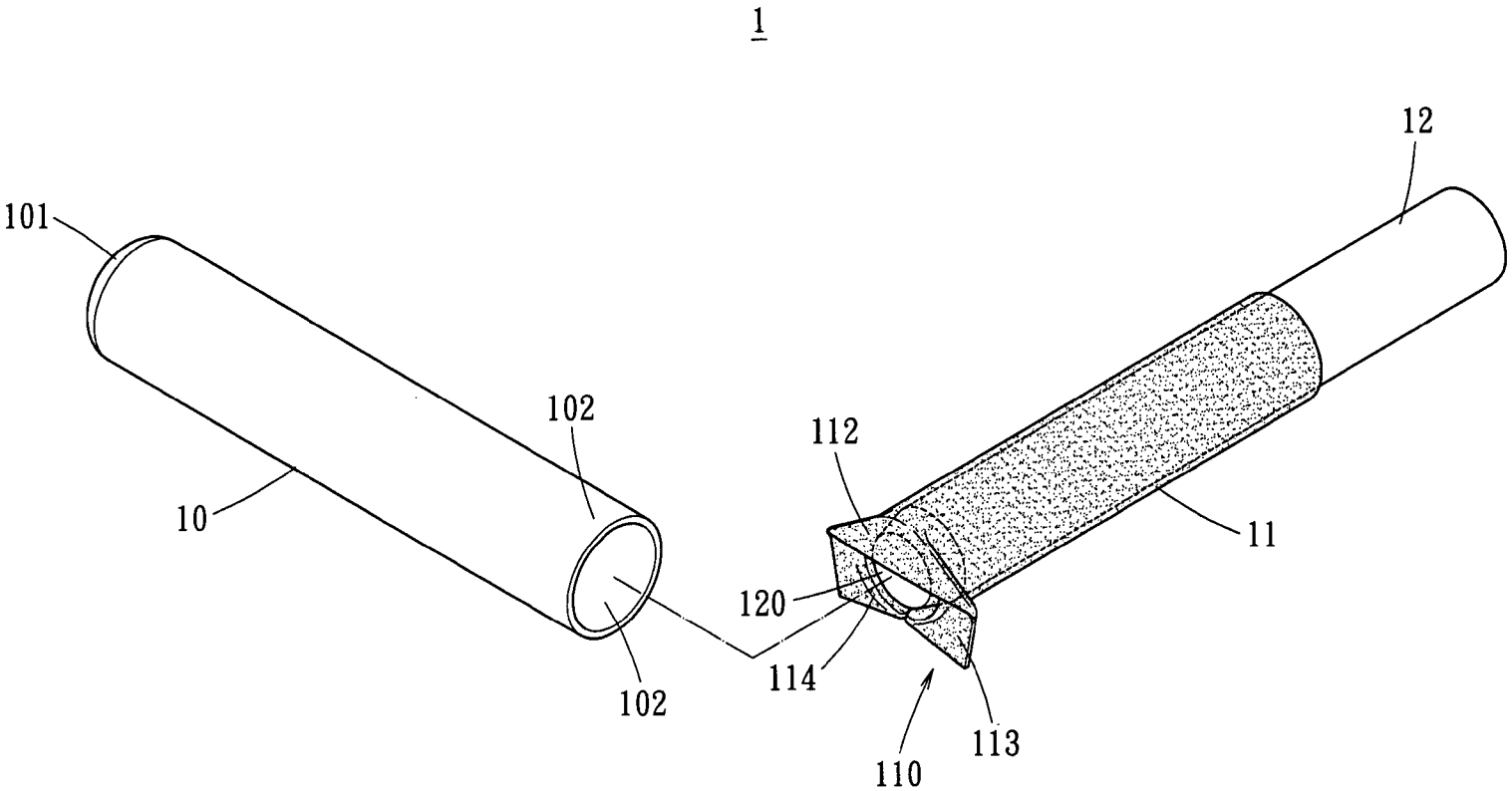
FIG. 3 shows the pressed wick structure to be inserted in the hollow tube of the heat pipe.
Figure 4:
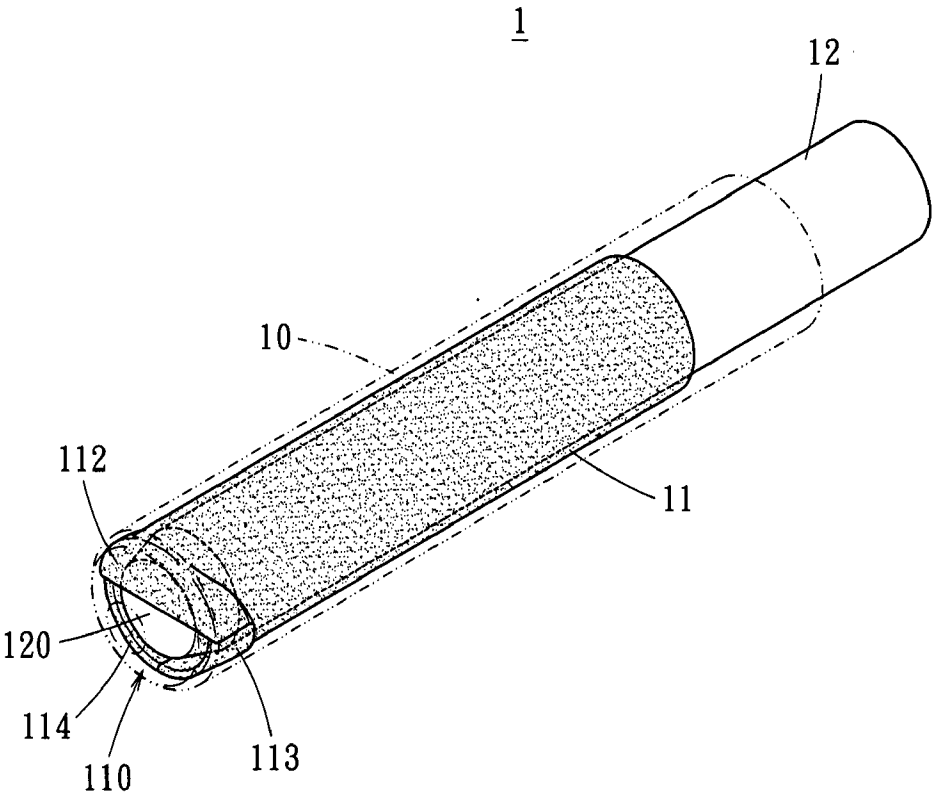
FIG. 4 shows wick structure inserted in the hollow tube when the core bar is not withdrawn therefrom.

Referring to FIGS. 2, 3 and 4, a press mechanism 2 is applied to press the hollow column 110 inwardly with respect to the hollow tube 10 (as shown in FIG. 2), such that the folded column 110 is bent to form a folded surface 112 attaching on the end surface 120 of the hollow tube 10, and two counter-folded surfaces 113 and 114 extending outwardly from two sides of the folded surface 112 as shown in FIG. 3. The edges at two side of the folded surface 112 are overlapped with the counter-folded surfaces 113 and 114. Therefore, by inserting the core bar 12 into the hollow tube 10, the wick structure 11 winding about the core bar 12 is attaching on an interior surface of the hollow tube 10 as shown in FIGS. 4 and 6.

Referring to FIGS. 3 and 4, when the above wick structure 11 is inserted into the hollow tube 10, the counter-folded surfaces 113 and 114 at the opening 102 are bent to insert the hollow column 110 into the hollow tube 10. Thereby, the folded and counter-folded surfaces 112, 113 and 114 are sandwiched between the hollow tube 11 and the bulk of the wick structure 11. Thereby, a maximum tightness between the wick structure 11 and the hollow tube 10 is resulted, and the core bar 12 can easily and reliably guide the wick structure 11 into the hollow tube.

Figure 5:
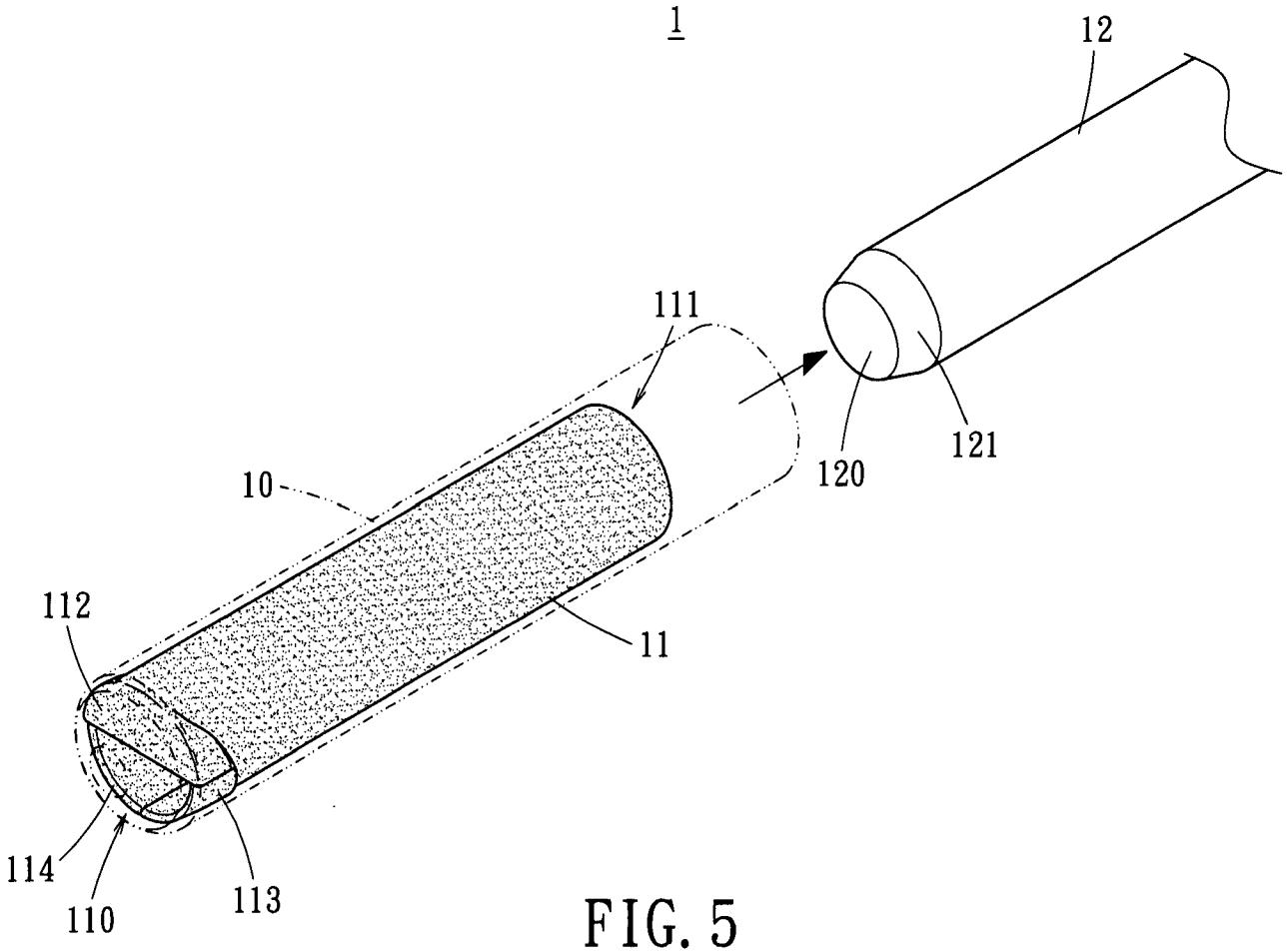
FIG. 5 shows the wick structure inserted in the hollow tube after the core bar is withdrawn therefrom.
Figure 6:
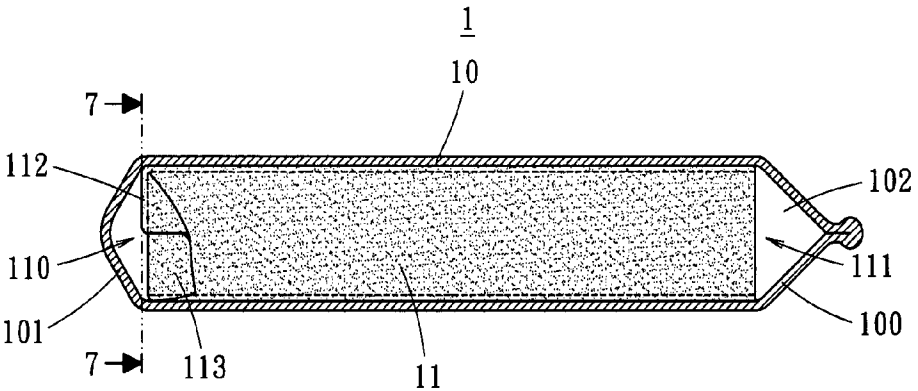
FIG. 6 shows a cross-sectional view of the heat pipe.

Referring to FIGS. 5 and 6, after the wick structure 11 is inserted into the hollow tube, the core bar 12 is withdrawn from the open part 111. A working fluid is injected into the hollow tube from the open part 111. Steps of removing vapor and other processes are performed (not shown), and the open end 102 is sealed, such that the ends 100 and 101 of the hollow tube 10 are sealed to form a closed heat pipe 1.

Figure 7:
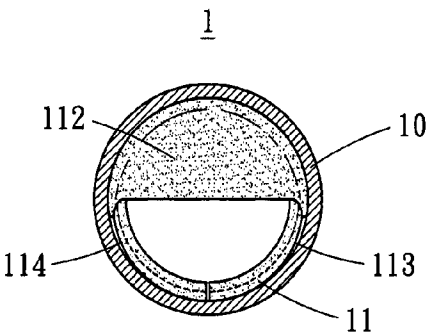
FIG. 7 shows the cross-sectional view along the line 7—7 of FIG. 6.

As shown in FIGS. 6 and 7, the present invention forms the folded parts 110 at two ends 100 and 101 of the tube 10 includes the hollow column 110 and the open part 111, where the hollow column 110 is pressed to form the folded surface 112 and the counter-folded surfaces 113 and 114 which are further sandwiched between the bulk of the wick structure 11 and the tube 10. Therefore, the wick structure 11 is tightly lining on the interior surface of the hollow tube 10. In the process of lining the wick structure 11 on the interior surface of the hollow tube 10, peeling or wrinkling is not easily caused due to the improved lining tightness. Therefore, the folded surface 112 provide a snapping mechanism for the wick structure 11 and the hollow tube 10, such that the process of lining the wick structure on the interior surface of the hollow tube can be performed by automatic equipment.

In addition, as shown in FIGS. 4 and 5, a slanted surface 121 may be formed on the end surface 120 of the core bar 12 for guiding the wick structure 11 into the tube 10. The slanted surface 121 is used to accommodate the counter-folded surfaces 113 and 114 to further support the lining process of the wick structure.

Other embodiments of the invention will appear to those skilled in the art from consideration of the specification and practice of the invention disclosed herein. It is intended that the specification and examples to be considered as exemplary only, with a true scope and spirit of the invention being indicated by the following claims.

What is claimed is:

1. A configured structure of a heat pipe wick structure, comprising:

a hollow tube having two opposing ends;

a wick structure inserted into the hollow tube and lining on an interior surface of the hollow tube; wherein the wick structure comprises an open part and a folding part at two ends thereof, the folding part includes a folded surface pressed inwardly with respect to the hollow tube and two counter-folded surfaces overlapped with two edges of the folded surface, the folded and counter-folded surfaces are sandwiched between a bulk of the wick structure and the hollow tube.

2. The configured structure of claim 1, wherein the wick structure is made of metal web.

3. The configured structure of claim 1, wherein the wick structure is made of fiber web.

4. The configured structure of claim 1, wherein wick structure is made of non-woven fabric mesh.

* * * * *